US012480372B2

(12) United States Patent
Tang et al.

(10) Patent No.: US 12,480,372 B2
(45) Date of Patent: Nov. 25, 2025

(54) POSITIONING AND ORIENTATING APPARATUS FOR BRANCH WELL, AND POSITIONING AND ORIENTATING METHOD

(71) Applicants: CHINA PETROLEUM & CHEMICAL CORPORATION, Beijing (CN); SINOPEC OILFIELD SERVICE CORPORATION, Beijing (CN); SINOPEC SHENGLI PETROLEUM ENGINEERING CO., LTD, Shandong (CN); DRILLING TECHNOLOGY RESEARCH INSTITUTE OF SINOPEC SHENGLI PETROLEUM ENGINEERING CO., LTD, Shandong (CN)

(72) Inventors: Honglin Tang, Shandong (CN); Han Liu, Shandong (CN); Hui Zhang, Shandong (CN); Zhonghua Wu, Shandong (CN); Chunxu Yang, Shandong (CN); Yong Chen, Shandong (CN); Zongfeng Zhao, Shandong (CN); Chuanwei Zhao, Shandong (CN); Rui Zhang, Shandong (CN); Junjie Zhang, Shandong (CN)

(73) Assignees: CHINA PETROLEUM & CHEMICAL CORPORATION, Beijing (CN); SINOPEC OILFIELD SERVICE CORPORATION, Beijing (CN); SINOPEC SHENGLI PETROLEUM ENGINEERING CO., LTD, Shandong (CN); DRILLING TECHNOLOGY RESEARCH INSTITUTE OF SINOPEC SHENGLI PETROLEUM ENGINEERING CO., LTD, Shandong (CN)

( * ) Notice: Subject to any disclaimer, the term of this patent is extended or adjusted under 35 U.S.C. 154(b) by 0 days.

(21) Appl. No.: 18/854,685

(22) PCT Filed: Apr. 7, 2023

(86) PCT No.: PCT/CN2023/086863
§ 371 (c)(1),
(2) Date: Oct. 7, 2024

(87) PCT Pub. No.: WO2023/197948
PCT Pub. Date: Oct. 19, 2023

(65) Prior Publication Data

US 2025/0354445 A1 Nov. 20, 2025

(30) Foreign Application Priority Data

Apr. 14, 2022 (CN) ..... 202210389729.7

(51) Int. Cl.
*E21B 23/01* (2006.01)
*E21B 47/09* (2012.01)

(52) U.S. Cl.
CPC ..... *E21B 23/01* (2013.01); *E21B 47/09* (2013.01)

(58) Field of Classification Search
CPC ..... E21B 23/01; E21B 47/09
See application file for complete search history.

(56) References Cited

U.S. PATENT DOCUMENTS 3,851,705 A * 12/1974 Jett ..... E21B 33/129 166/134
3,976,133 A * 8/1976 Allen ..... E21B 33/1295 166/134

(Continued)

FOREIGN PATENT DOCUMENTS

CN 203145886 U 8/2013
CN 113802994 A 12/2021

OTHER PUBLICATIONS

PCT Written opinion (Year: 2023).*

*Primary Examiner* — Steven A Macdonald
(74) *Attorney, Agent, or Firm* — NKL Law; Allen Xue

(57) ABSTRACT

A positioning and orientating apparatus for branch well, which has an orientating coupling shaft; a hydraulic cylinder (Continued)

having a guiding sleeve; a setting unit having an anchoring mechanism and a sealing mechanism; a setting actuation unit, having a sealing cylinder, a piston, and a force transmitting cylinder, wherein an upper end of the force transmitting cylinder is fixedly connected to the piston, a sealing chamber in communication with the central flow channel is formed within the sealing cylinder, and the piston is configured to drive the force transmitting cylinder to move downwards when a pressure of the drilling fluid reaches a first pressure; and a releasing unit having a pressure-bearing cylinder, an elastic claw, and a ball seat. The elastic claw is separated from the slot by lifting up the releasing unit when the pressure of the drilling fluid reaches a second pressure, thus completing a releasing procedure.

15 Claims, 6 Drawing Sheets

(56) References Cited

U.S. PATENT DOCUMENTS 3,991,826 A * 11/1976 Baugh ..... E21B 33/1295 166/212
4,153,109 A * 5/1979 Szescila ..... E21B 7/061 166/123
4,216,827 A * 8/1980 Crowe ..... E21B 33/1295 166/182
4,224,987 A * 9/1980 Allen ..... E21B 33/1295 166/120
4,345,649 A * 8/1982 Baugh ..... E21B 33/1295 166/120
4,441,559 A * 4/1984 Evans ..... E21B 33/1295 166/212
4,487,258 A * 12/1984 Jackson ..... E21B 33/1295 166/120
4,526,229 A * 7/1985 Dickerson ..... E21B 33/1295 166/120
5,141,053 A * 8/1992 Restarick ..... E21B 33/1295 166/182
5,180,016 A * 1/1993 Ross ..... E21B 43/10 166/239
5,425,419 A * 6/1995 Sieber ..... E21B 7/061 166/117.6
11,401,763 B2 * 8/2022 Al-Mousa ..... E21B 33/1272
2003/0034156 A1 * 2/2003 Gondouin ..... E21B 7/065 166/117.5
2005/0217869 A1 * 10/2005 Doane ..... E21B 33/1295 166/387
2013/0213654 A1 * 8/2013 Dewey ..... E21B 33/13 166/117.6
2014/0338908 A1 * 11/2014 Ervin ..... E21B 17/042 166/113
2019/0242208 A1 * 8/2019 Estrada-Giraldo ..... E21B 41/00
2020/0270967 A1 * 8/2020 Fong ..... E21B 33/1294
2021/0054708 A1 * 2/2021 Al-Mousa ..... E21B 33/134

* cited by examiner

POSITIONING AND ORIENTATING APPARATUS FOR BRANCH WELL, AND POSITIONING AND ORIENTATING METHOD

CROSS REFERENCE OF RELATED APPLICATIONS

This Application is a U.S. national stage entry of PCT International Application No. PCT/CN2023/086863, filed on Apr. 7, 2023, which claims the priority of Chinese patent application No. 202210389729.7 entitled "POSITIONING AND ORIENTATING APPARATUS FOR BRANCH WELL" and filed on Apr. 14, 2022, the content of which is incorporated herein by reference in its entirety.

TECHNICAL FIELD

The present invention relates to the technical field of oil and gas exploitation, and specifically to a positioning and orientating apparatus for branch well. The present invention further relates to a positioning and orientating method for branch well.

TECHNICAL BACKGROUND

During the exploitation of petroleum or natural gas, it is a low-cost, high-benefit and promising development method with great potential for sidetrack drilling abandoned wells or old wells to obtain branch wells, in order to reduce the number of single wells required for the development of oil and gas reservoirs, save the costs repeatedly incurred on single wells and corresponding devices (such as casing, oil production platform and wellhead, etc.), and reduce the impact on the environment.

Downhole positioning and orientating technology for branch well is one of the important technologies for branch well completion. At present, for all branch well completion technologies, it is necessary to arrange a downhole positioning and orientating apparatus in advance, as a reference for other tools and subsequent operations. However, existing positioning and orientating apparatuses cannot be securely connected to the well wall, and thus are prone to displacement which affects the accuracy of positioning and orientating. In addition, existing positioning and orientating apparatuses have limited functions, which cannot realize positioning tieback, hanging and packing at the same time, or continuously perform the functions of running, hanging, packing and releasing, leading to low operation efficiency.

SUMMARY OF THE INVENTION

In view of the above technical problems, the present invention aims to propose a positioning and orientating apparatus for branch well and a positioning and orientating method. The positioning and orientating apparatus is able to be securely anchored to the well wall, thereby avoiding displacement thereof, and effectively ensuring the accuracy of positioning and orientating thereof. The positioning and orientating method can continuously perform the functions of running, hanging, packing and releasing, which is very conducive to high operational efficiency.

Aimed at solving the above technical problems, a first aspect of the present invention proposes a positioning and orientating apparatus for branch well, which comprises an orientating coupling shaft, with a central flow channel provided therein for flow of drilling fluid; a hydraulic cylinder, arranged at a downstream end of the orientating coupling shaft, with a guiding sleeve fixedly connected to an upper end of the hydraulic cylinder; a setting unit, arranged on the hydraulic cylinder, and comprising an anchoring mechanism and a sealing mechanism arranged at a lower end of the anchoring mechanism; a setting actuation unit, comprising a sealing cylinder arranged around the orientating coupling shaft, a piston arranged inside the sealing cylinder, and a force transmitting cylinder arranged around the guiding sleeve, wherein an upper end of the force transmitting cylinder extends upwards to be fixedly connected to the piston, a sealing chamber in communication with the central flow channel is formed within the sealing cylinder, and the piston is configured to drive the force transmitting cylinder to move downwards when a pressure of the drilling fluid reaches a first pressure, in order to drive the anchoring mechanism to be anchored securely to an inner wall of a wellbore, and drive the sealing mechanism to form a seal with the inner wall of the wellbore; and a releasing unit, connected to a lower end of the orientating coupling shaft, and comprising a pressure-bearing cylinder fixedly connected to the lower end of the orientating coupling shaft, an elastic claw arranged around the pressure-bearing cylinder, and a ball seat fixedly connected to a lower end of the pressure-bearing cylinder, wherein an inner wall of the guiding sleeve is provided with a slot which engages with the elastic claw by snap fitting in an initial state, and the ball seat is configured to receive a ball dropped from a wellhead to build up pressure, so that the elastic claw is separated from the slot by lifting up the releasing unit when the pressure of the drilling fluid reaches a second pressure, thus completing a releasing procedure, wherein the first pressure is less than the second pressure.

In one embodiment, the anchoring mechanism comprises a slip arranged on an outer surface of the hydraulic cylinder; and a first cone and a second cone arranged symmetrically on both axial ends of the slip, wherein the slip engages with the first cone and the second cone through tapered surfaces, and is configured to retract in the initial state, and to expand radially outwards when the first cone and the second cone are close to each other in an axial direction due to axial forces, so as to be anchored securely to the inner wall of the wellbore.

In one embodiment, the anchoring mechanism further comprises a slip nest provided on an outer side of the first cone and the second cone, wherein the slip is connected to the hydraulic cylinder through an elastic member, and configured to retract to be located inside the slip nest in the initial state, while extend outwards from the slip nest when the first cone and the second cone are subjected to the axial forces.

In one embodiment, an anchor jaw is arranged on a surface of the slip facing away from the hydraulic cylinder, and configured as having four-pronged teeth each with an outer edge inclined toward a center of the slip.

In one embodiment, a first retaining ring is provided at an upper end of the first cone, and a second retaining ring is provided at a lower end of the second cone, for preventing the first cone and the second cone from retreating, respectively.

In one embodiment, the sealing mechanism comprises a rubber cylinder arranged on the hydraulic cylinder; and a first rubber cylinder gasket and a second rubber cylinder gasket arranged at upper and lower ends of the rubber cylinder, respectively, wherein the first rubber cylinder gasket and the second rubber cylinder gasket are configured to, when axially close to each other due to axial forces, press the rubber cylinder to expand outwardly along a radial direction until tightly abutting against the inner wall of the wellbore, thereby forming a seal.

In one embodiment, a force-bearing step is formed at an upper end of the first rubber cylinder gasket, for engagement with a lower end of the slip nest to transmit axial force.

In one embodiment, a lower joint is fixedly connected to a lower end of the hydraulic cylinder, and a cushioning member is provided between the second rubber cylinder gasket and the lower joint along the axial direction, for cushioning compression on the rubber cylinder.

In one embodiment, an upper end of the sealing cylinder is fixedly connected to the orientating coupling shaft through a sealing joint, and the sealing chamber is formed between the sealing joint and the orientating coupling shaft, wherein a pressure transmitting hole for communicating with the sealing chamber is formed on a wall of the orientating coupling shaft.

In one embodiment, an annular projection extending outwards in the radial direction is arranged on an upper outer wall of the piston, and a piston sleeve is arranged around the piston, a lower end of the piston sleeve extending downwardly to be fixedly connected to the force transmitting cylinder, and an upper end thereof abutting against a lower end surface of the annular projection, wherein in the initial state, the piston sleeve is fixedly connected to the sealing cylinder through a first shear pin, and the force transmitting cylinder is fixedly connected to the guiding sleeve through a second shear pin, and when the pressure of the drilling fluid in the sealing chamber reaches the first pressure, the first shear pin and the second shear pin are simultaneously sheared off, so that the piston drives the force transmitting cylinder to move downwards.

In one embodiment, the setting actuation unit further comprises a motion sleeve arranged on the hydraulic cylinder and between the force transmitting cylinder and the first cone, for transmitting the axial force from the force transmitting cylinder to the first cone.

In one embodiment, a shoulder with an end surface facing downwards is provided on an inner wall of the motion sleeve, so that an annular space with an opening facing downwards is formed between the shoulder and the hydraulic cylinder, wherein the first retaining ring is arranged in the annular space.

In one embodiment, the releasing unit further comprises a shear ferrule arranged on the pressure-bearing cylinder, and a hydraulic chamber, which is formed between the shear ferrule and the pressure-bearing cylinder, is in communication with a hydraulic hole on a wall of the pressure-bearing cylinder, wherein in the initial state, the shear ferrule is fixedly connected to the pressure-bearing cylinder through a third shear pin, an upper end of the shear ferrule extends to a radially inner side of the elastic claw to radially support the elastic claw, and the shear ferrule is configured to shear off, when the pressure of the drilling fluid in the hydraulic chamber reaches the second pressure, the third shear pin and then move downwards to remove radial support for the elastic claw.

In one embodiment, an upper portion of the guiding sleeve is provided with a spirally-shaped guiding track and a positioning slot, and the guiding sleeve is configured to, when being tied back with an upper string, guide a positioning key of the upper string to slide into the positioning slot via the guiding track, thus achieving orientation of the upper string.

A second aspect of the present invention proposes a positioning and orientating method for branch well, which comprises steps of:

providing the positioning and orientating apparatus for branch well as mentioned above;

lowering the positioning and orientating apparatus to a predetermined position in the wellbore;

dropping the ball from the wellhead to be received by the ball seat in the releasing unit to build up pressure, and when the pressure of the drilling fluid reaches the first pressure, driving, by the setting actuation unit, the anchoring mechanism to anchor securely to the inner wall of the wellbore, and at the same time, driving the sealing mechanism to form a seal with the inner wall of the wellbore, thus completing the setting procedure; and building up the pressure continuously until the pressure of the drilling fluid reaches the second pressure, and lifting up the releasing unit to separate it from the guiding sleeve, so that the releasing unit and the setting actuation unit are lifted out of the wellhead together, thereby completing the releasing procedure.

Compared with the prior arts, the present application has the following advantages.

According to the present invention, the positioning and orientating apparatus for branch well can be securely anchored to the well wall through the setting unit with a high degree of stability and reliability, which can effectively avoid displacement and realize permanent anchoring at the same time. The guiding sleeve in the positioning and orientating apparatus has a spirally-guiding structure with high positioning and orientating accuracy, which can ensure that the subsequent operations including running a whipstock for windowing can be performed smoothly, and is conducive to the accuracy of positioning and orientating. The positioning and orientating method according to the present invention can realize continuous running, hanging, packing and releasing, which can be operated simply, conveniently and efficiently.

BRIEF DESCRIPTION OF THE DRAWINGS

In the following, the present invention will be described with reference to the accompanying drawings.

In the present application, all accompanying drawings are schematic ones, provided to illustrate the principle of the present invention merely, and are not necessarily drawn to actual scale.

DETAILED DESCRIPTION OF EMBODIMENTS

The present invention will be described below with reference to the accompanying drawings.

For the sake of convenience, in the present application, an end proximate to the wellhead is defined as an upper end, an upstream end, or the like, while an end away from the wellhead is defined as a lower end, a downstream end, or the like. Meanwhile, a direction along the length of the positioning and orientating apparatus for branch well is defined as a longitudinal direction, an axial direction, or the like, while a direction perpendicular thereto is defined as a lateral direction, a radial direction, or the like. It should also be noted that the terms or determiners indicating directions "upper", "lower", or the like in the present application are all directed to FIG. 1, and are used for illustrative purposes of the present invention and simplified illustration only, which are not intended to indicate or imply the absolute orientation of the devices and components involved, or that the devices and components are configured or operated in a particular orientation. Therefore, these terms or determiners are not to be construed as limitations to the present invention.

Figure 1:
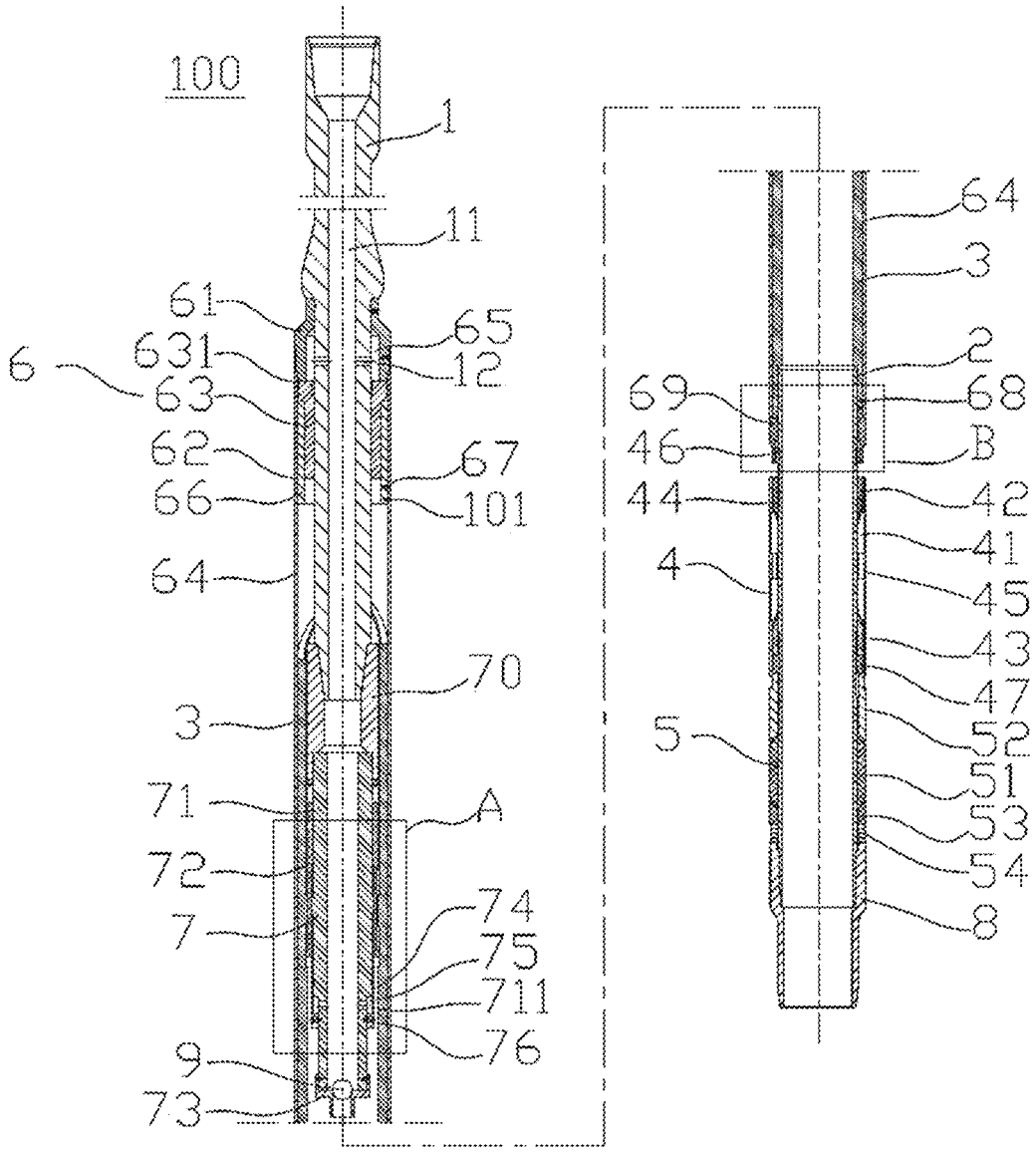
FIG. 1 shows a structure of a positioning and orientating apparatus for branch well according to the present invention.

FIG. 1 shows a structure of a positioning and orientating apparatus 100 for branch well according to the present invention. As shown in FIG. 1, the positioning and orientating apparatus 100 includes an orientating coupling shaft 1, a hydraulic cylinder 2, a setting unit, a setting actuation unit 6, and a releasing unit 7. A central flow channel 11 in which drilling fluid flows is arranged within the orientating coupling shaft 1. The hydraulic cylinder 2 is arranged at a downstream end of the orientating coupling shaft 1, and a guiding sleeve 3 is fixedly connected to an upper end of the hydraulic cylinder 2. The setting unit, which is arranged on the hydraulic cylinder 2, comprises an anchoring mechanism 4 and a sealing mechanism 5 arranged at a lower end of the anchoring mechanism 4. The releasing unit 7, which is connected to a lower end of the orientating coupling shaft 1, is configured to build up pressure through a ball 9 dropped from the wellhead. The setting actuation unit 6 is configured to drive the anchoring mechanism 4 to anchor securely to an inner wall of the wellbore, and to drive the sealing mechanism 5 to form a seal with the inner wall of the wellbore, when the built-up pressure reaches a first pressure. The releasing unit 7 is further configured to engage with and thus fixedly connected to the guiding sleeve 3 in an initial state, and to move upwards to be separated from the guiding sleeve 3 by lifting up a string when the built-up pressure reaches a second pressure larger than the first pressure. In this manner, the releasing unit 7 and the setting actuation unit 6 can be lifted out of the wellhead together. The releasing procedure can thus be completed.

As shown in FIG. 1, the orientating coupling shaft 1 is shaped as a cylinder extending in an axial direction. A female joint is arranged at an upper end of the orientating coupling shaft 1, and a male joint is arranged at a lower end thereof, both for connecting to other components. A limit step with an end surface facing downwards is arranged on an outer wall of the orientating coupling shaft 1, the function of which will be described below in this context.

According to the present invention, as shown in FIG. 1, the anchoring mechanism 4 comprises a slip 41 arranged on an outer surface of the hydraulic cylinder 2, and a first cone 42 and a second cone 43 arranged symmetrically on both axial ends of the slip 41. The slip 41 engages with the first cone 42 and the second cone 43 through tapered surfaces. The slip 41 retracts radially in an initial state. When the first cone 42 and the second cone 43 are close to each other due to axial forces, the slip 41 can expand radially outwards in view of the tapered surfaces, so that the slip 41 can be anchored securely to the inner wall of the wellbore. The setting actuation unit 6 exerts axial forces on the first cone 42 and the second cone 43, the detailed principle and procedure of which will be described below in this context.

In one embodiment, the anchoring mechanism 4 further comprises a slip nest 44 provided on an outer side of the first cone 42 and the second cone 43. The slip 41 is connected to the hydraulic cylinder 2 through an elastic member 45. In the initial state, the slip 41 retracts to be located inside the slip nest 44 under the action of the elastic member 45. When the first cone 42 and the second cone 43 are subjected to axial forces, the slip 41 is able to extend radially outwards from the slip nest 44 against the elastic force of the elastic member 45. The elastic member 45 may be, for example, a tension spring, but is not limited thereto. In practice, at least two slips 41 are provided, which are evenly distributed along a circumferential direction of the hydraulic cylinder 2. Each of the elastic members 45 is provided with a corresponding slip 41. Such a structure of the slip 41 enables the positioning and orientating apparatus 100 to be firmly anchored to the well wall, thus avoiding displacement and ensuring the accuracy of positioning and orientating.

The slip nest 44 may be, for example, a cylinder with a plurality of through holes evenly distributed thereon, the shape of the through holes being adapted to that of the slips 41.

Figure 3:
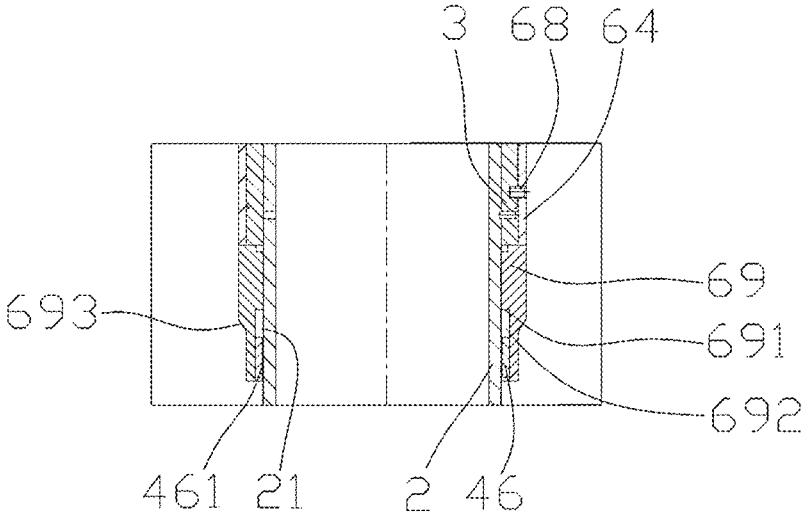
FIG. 3 is an enlargement view of Area B in FIG. 1.
Figure 4:
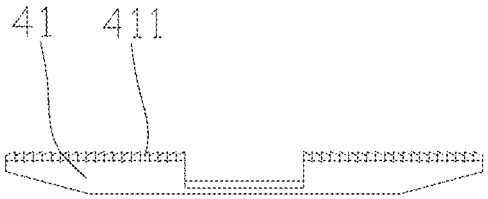
FIGS. 4 to 6 schematically show a structure of a slip in the positioning and orientating apparatus for branch well as shown in FIG. 1.
Figure 5:
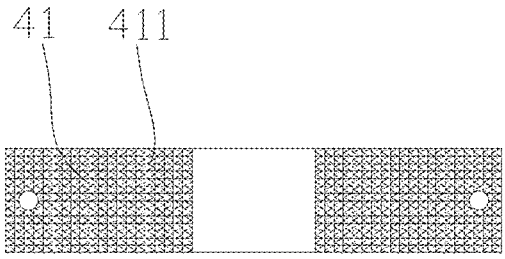
Figure 6:
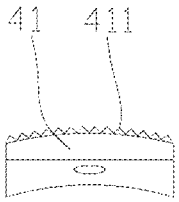

FIGS. 3 to 5 schematically show a structure of the slip 41. As shown in FIGS. 3 to 5, an anchor jaw 411, which is provided on a surface of the slip 41 facing away from the hydraulic cylinder 2, is configured as having four-pronged teeth each with an outer edge inclined toward a center of the slip 41. The above structure of the slips 41 not only effectively prevents the positioning and orientating apparatus 100 from moving upwards, downwards or circumferentially after being anchored, but also significantly enhances the anchoring stability of the positioning and orientating apparatus 100.

In addition, the slip 41 has an upper receiving surface and a lower receiving surface facing the hydraulic cylinder 2, both of which have a tapered structure. A first tapered driving surface tapering downwardly and adapted to the upper receiving surface is provided on an outer wall of the first cone 42, and a second tapered driving surface tapering upwardly and adapted to the lower receiving surface is provided on an outer wall of the second cone 43. The first cone 42 abuts against the upper receiving surface through the first tapered driving surface, and the second cone 43 abuts against the lower receiving surface through the second tapered driving surface. Thus, a tapered fit is achieved between the slips 41, the first cone 42 and the second cone 43.

As shown in FIG. 1, a first retaining ring 46 is provided at an upper end of the first cone 42, and a second retaining ring 47 is provided at a lower end of the second cone 43, for preventing the first cone 42 and the second cone 43 from moving backwards, respectively, so that the slips 41 can be anchored permanently. In one embodiment, the first retaining ring 46 is an open ring, while a neck portion is provided on an outer wall surface of the hydraulic cylinder 2. When the first retaining ring 46 slides down to the neck portion on the hydraulic cylinder 2, the first retaining ring 46 will be contracted under its own recovery force to fit the neck portion, and cannot slide out of the neck portion, so that the slips 41 can be anchored permanently. The second retaining ring 47 is fixedly connected to the hydraulic cylinder 2.

Of course, the first retaining ring 46 may also have a ratchet structure to prevent backward movement. For example, a number of inclined first ratchets extending upwardly are arranged on an inner wall surface of the first retaining ring 46, and a number of inclined second ratchets extending downwardly are arranged on the outer wall surface of the hydraulic cylinder 2, wherein the first ratchets and the second ratchets form a snap-fit, so that the first retaining ring 46 prevents the first cone 42 from moving upwards. In this manner, the first cone 42 can be prevented from being displaced upwards after the slips 41 are anchored, so that the slips 41 can be effectively actuated by the first cone 42 and the second cone 43, and anchored to the inner wall of the wellbore more reliably.

According to the present invention, as shown in FIG. 1, the sealing mechanism 5 comprises a rubber cylinder 51 arranged on the hydraulic cylinder 2, and a first rubber cylinder gasket 52 and a second rubber cylinder gasket 53 arranged at upper and lower ends of the rubber cylinder 51, respectively. When the first rubber cylinder gasket 52 and the second rubber cylinder gasket 53 are axially close to each other due to axial forces, the rubber cylinder 51 is pressed to expand outwardly along the radial direction until it tightly abuts against the inner wall of the wellbore, thus forming a seal.

In one embodiment, a force-bearing step is formed at an upper end of the first rubber cylinder gasket 52, for engaging with a lower end of the slip nest 44 to transmit axial force. The setting actuation unit 6 can be activated to transmit the axial force to the slip nest 44, so that the slip nest 44 is able to move axially downward until the lower end thereof engages with the force-bearing step of the first rubber cylinder gasket 52, thus transmitting the axial force to the first rubber cylinder gasket 52. Therefore, the first rubber cylinder gasket 52 and the second rubber cylinder gasket 53 work together to axially compress the rubber cylinder 51, which can thus expand in the radial direction until it tightly abuts against the inner wall of the wellbore, thus forming a seal.

Preferably, the end surfaces of the first rubber cylinder gasket 52 and the second rubber cylinder gasket 53 in contact with the rubber cylinder 51 are formed as tapering fit structures. Specifically, a lower end surface of the first rubber cylinder gasket 52 and an upper end surface of the second rubber cylinder gasket 53 are formed as inclined surfaces toward the hydraulic cylinder 2. The upper and lower ends of the rubber cylinder 51 are surrounded by the inclined surfaces of the first rubber cylinder gasket 52 and the second rubber cylinder gasket 53 to form axial limit. This structure not only protects the rubber cylinder 51, but also ensures the effect and stability of the rubber cylinder 51 expanding along the radial direction during setting, which is conducive to the good sealing effect between the rubber cylinder 51 and the inner wall of the wellbore.

In one embodiment, a lower joint 8 is fixedly connected to a lower end of the hydraulic cylinder 2 for connecting to other components, as shown in FIG. 1. The lower joint 8 is fixedly connected to the hydraulic cylinder 2 through threads. A cushioning member 54 is provided between the second rubber cylinder gasket 53 and the lower joint 8 in the axial direction, for cushioning the compression on the rubber cylinder 51. An upper end surface of the cushioning member 54 abuts against a lower end surface of the second rubber cylinder gasket 53, and a lower end surface of the cushioning member 54 abuts against an axial upper end surface of the lower joint 8. The cushioning member 54 is able to effectively cushion the compression on the rubber cylinder 51, preventing the rubber cylinder 51 from being damaged by large and sudden pressure. The cushioning member 54 may be, for example, a disc spring, but is not limited thereto.

According to the present invention, as shown in FIG. 1, the setting actuation unit 6 comprises a sealing joint 61, a sealing cylinder 62, a piston 63 and a force transmitting cylinder 64. The sealing cylinder 62 is provided on an outer side of the orientating coupling shaft 1, with an upper end of the sealing cylinder 62 fixedly connected to the orientating coupling shaft 1 through the sealing joint 61. The piston 63, which is arranged around the orientating coupling shaft 1 and inside the sealing cylinder 62, is able to slide downwards along the orientating coupling shaft 1. The force transmitting cylinder 64 is arranged on an outer side of the guiding sleeve 3, with an upper end thereof extending upwards to be fixedly connected to the piston 63. A sealing chamber 65 is formed between the sealing joint 61, the orientating coupling shaft 1 and an upper end surface of the piston 63. A pressure transmitting hole 12 is provided on a side wall of the orientating coupling shaft 1 corresponding to the sealing chamber 65, so that the drilling fluid in the central flow channel 11 of the orientating coupling shaft 1 can enter the sealing chamber 65 through the pressure transmitting hole 12. Thus the piston 63 can drive the force transmitting cylinder 64 to move downwards when the pressure of the drilling fluid in the sealing chamber 65 reaches the first pressure.

In one embodiment, the sealing joint 61 comprises a first cylindrical segment and a second cylindrical segment connected to a lower end of the first cylindrical segment, wherein a diameter of the first cylindrical segment is less than that of the second cylindrical segment. An upper end surface of the first cylindrical segment abuts against the limit step of the orientating coupling shaft 1, and a sealing connection is formed between the first cylindrical segment and the orientating coupling shaft 1. The sealing chamber 65 is formed within a space between the second cylindrical segment and the orientating coupling shaft 1 along the radial direction.

An outer surface of the second cylindrical segment of the sealing joint 61 is fixedly connected to the sealing cylinder 62 through threads, with an anti-rotating pin arranged to prevent the rotation therebetween.

As shown in FIG. 1, an annular projection 631 extending outwards in the radial direction is arranged on an upper outer wall of the piston 63, and a piston sleeve 66 is arranged on an outer side of the piston 63. A lower end of the piston sleeve 66 extends downwardly to be fixedly connected to the force transmitting cylinder 64, and an upper end thereof abuts against a lower end surface of the annular projection 631. Preferably, the piston sleeve 66 is fixedly connected to the force transmitting cylinder 64 through threads, with an anti-rotating pin 101 arranged therebetween to prevent them from rotating relative to each other. A dynamic seal is formed between an inner wall surface of the piston 63 and the orientating coupling shaft 1, and between an outer wall surface of the annular projection 631 and the sealing cylinder 62.

In actual practice, the piston sleeve 66 is fixedly connected to the sealing cylinder 62 through a first shear pin 67, and the force transmitting cylinder 64 is fixedly connected to the guiding sleeve 3 through a second shear pin 68 in the initial state. The second shear pin 68 is preferably arranged close to a lower end of the force transmitting cylinder 64. When the pressure of the drilling fluid in the sealing chamber 65 reaches the first pressure, the first shear pin 67 and the second shear pin 68 are simultaneously sheared off, allowing the piston 63 to drive the force transmitting cylinder 64 to move downwards.

According to the present invention, as shown in FIGS. 1 and 3, the setting actuation unit 6 further comprises a motion sleeve 69 arranged on the hydraulic cylinder 2 and between the force transmitting cylinder 64 and the first cone 42, for transmitting the axial force from the force transmitting cylinder 64 to the first cone 42. A shoulder 691 with an end surface facing downwards is provided on an inner wall of the motion sleeve 69, and an annular space 692 with an opening facing downwards is formed between the shoulder 691 and the hydraulic cylinder 2. The first retaining ring 46 is arranged in the annular space 692. The force transmitting cylinder 64 is configured to push the motion sleeve 69 and the first retaining ring 46 to move downwards, in order to exert the axial force on the first cone 42, and prevent the first cone 42 from moving backwards through the first retaining ring 46.

In the meantime, a pressure-bearing step 693 with an end surface facing downwards is arranged on an outer wall surface of the motion sleeve 69 for engaging with an upper end of the slip nest 44, in order to transmit the axial force from the setting actuation unit 6 to the slip nest 44, which, in turn, provides a force for activating the sealing mechanism 5.

Figure 2:
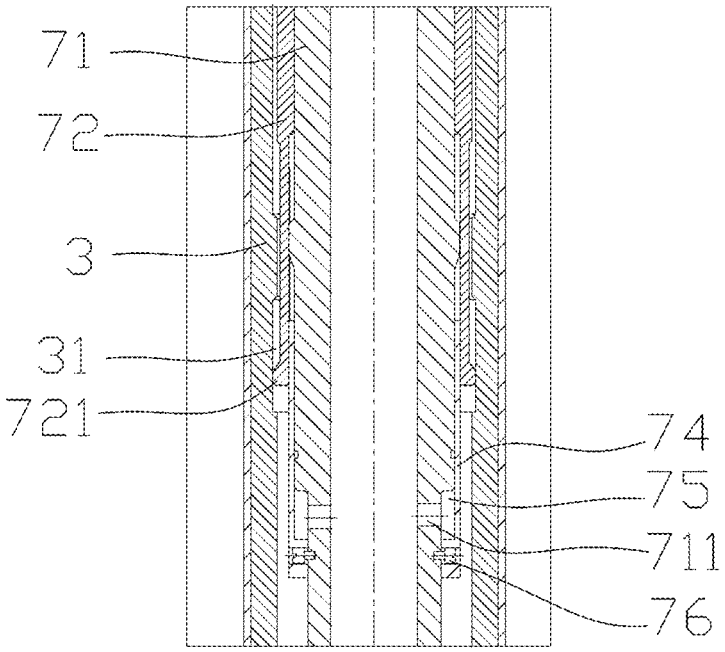
FIG. 2 is an enlargement view of Area A in FIG. 1.

According to the present invention, as shown in FIGS. 1 and 2, the releasing unit 7 comprises a pressure-bearing cylinder 71, an elastic claw 72 and a ball seat 73. The pressure-bearing cylinder 71 is fixedly connected to the lower end of the orientating coupling shaft 1, preferably through a sub joint 70. The elastic claw 72 is fixedly mounted on an outer side of the pressure-bearing cylinder 71. The ball seat 73, which is fixedly attached to a lower end of the pressure-bearing cylinder 71, is configured to receive the ball 9 which is dropped from the wellhead to build up pressure. An inner wall of the guiding sleeve 3 is provided with a slot 31, in which a claw portion 721 of the elastic claw 72 is snap-fit in the initial state, so that the releasing unit 7 is fixedly connected to the guiding sleeve 3. The elastic claw 72 can be disengaged from the slot 31 by lifting up the releasing unit 7 when the pressure of the drilling fluid reaches the second pressure. In this manner, the releasing procedure is completed.

As shown in FIG. 2, the releasing unit 7 further comprises a shear ferrule 74 arranged on the pressure-bearing cylinder 71. A hydraulic chamber 75 formed between the shear ferrule 74 and the pressure-bearing cylinder 71 is in communication with a hydraulic hole 711 on a wall of the pressure-bearing cylinder 71. Specifically, the pressure-bearing cylinder 71 has an outer step portion with an end surface facing downwards, and an inner step portion with an end surface facing upwards is provided on a lower inner wall of the shear ferrule 74, wherein the hydraulic chamber 75 is formed between the outer step portion and the inner step portion in the axial direction.

In the initial state, the shear ferrule 74 is fixedly connected to the pressure-bearing cylinder 71 through a third shear pin 76, and an upper end of the shear ferrule 74 extends to a radial inner side of the elastic claw 72 to radially support the elastic claw 72. The third shear pin 76 preferably extends through the inner step portion to be fixedly connected to the pressure-bearing cylinder 71. When the pressure of the drilling fluid in the hydraulic chamber 75 reaches the second pressure, the shear ferrule 74 is able to shear off the third shear pin 76 under the pressure of the drilling fluid, and then move downwards to remove the radial support for the elastic claw 72. At this time, the pressure-bearing cylinder 71 and the elastic claw 72 can be driven upwards by lifting up the string, so that the claw portion 721 of the elastic claw 72 can be disengaged from the slot 31 of the guiding sleeve 3. In this manner, the releasing unit 7 can be separated from the guiding sleeve 3, thus completing the releasing procedure.

Figure 7:
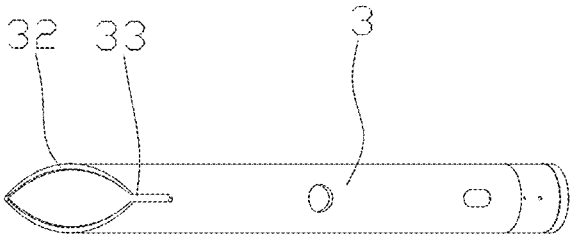
FIG. 7 schematically shows a structure of a guiding sleeve in the positioning and orientating apparatus for branch well as shown in FIG. 1.

According to the present invention, as shown in FIG. 7, an upper portion of the guiding sleeve 3 is provided with a spirally-shaped guiding track 32 and a positioning slot 33. The guiding sleeve 3 is configured to, when tied back with an upper string (not shown), guide a positioning key on the upper string to slide into the positioning slot 33 via the guiding track 32, so that the upper string can be oriented at a prescribed azimuthal angle. In this manner, the orientation of the upper string is completed.

In an embodiment not shown, a rupture disc or an aluminum sealing block is attached to a lower end of the lower joint 8 for sealing the main borehole, thus facilitating continuous running, hanging, packing, and releasing procedures.

The positioning and orientating apparatus 100 for branch well according to the present invention can serve as a positioning basis for re-entry, which ensures that the obstruction encountered by the branch completion tool running in the wellbore can be handled, and realizes the operation of drilling, setting and releasing can be completed during one trip. The apparatus is best applied in the field of branch well and sidetracking well, and is also applicable to the completion operation for straight wells, inclined wells, horizontal wells, and extended reach wells.

The present invention further relates to a positioning and orientating method for branch well, which is performed through the positioning and orientating apparatus 100 for branch well as described above. The positioning and orientating method will be described in detail as follows in combination with the positioning and orientating apparatus 100.

First, the positioning and orientating apparatus 100 is assembled and lowered into the wellbore to a predetermined position. As shown in FIG. 1, the positioning and orientating apparatus 100 is in the initial state during the running procedure, and the setting unit, the setting actuation unit 6 and the releasing unit 7 are not actuated.

Figure 8:
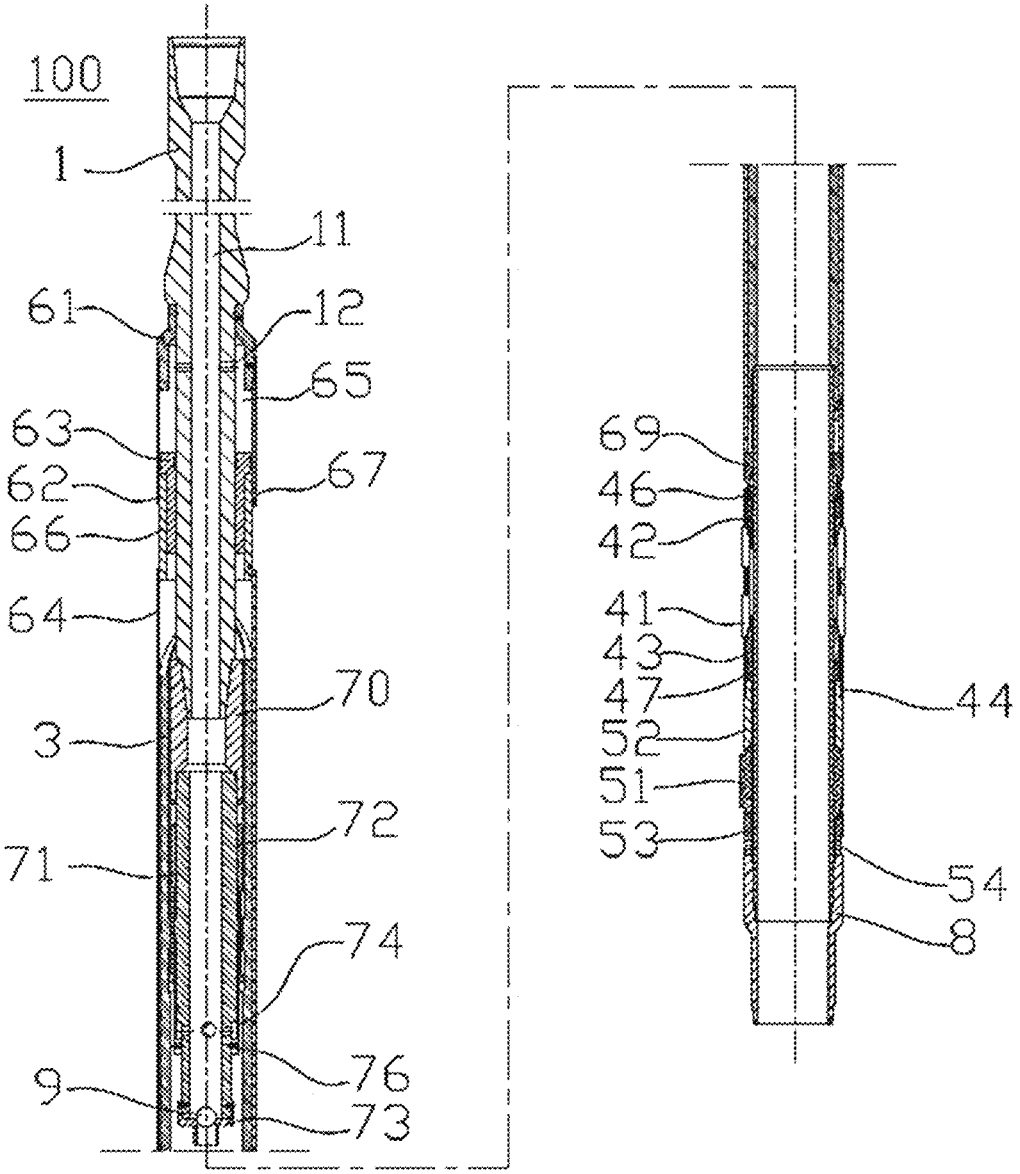
FIG. 8 schematically shows a structure of the positioning and orientating apparatus for branch well as shown in FIG. 1 after a setting unit is set.

Afterwards, the ball 9 is dropped from the wellhead, which moves down through the central flow channel 11 of the orientating coupling shaft 1, until it is received by the ball seat 73 in the releasing unit 7, so that the pressure can be built up. As shown in FIG. 8, the setting actuation unit 6 is actuated when the pressure of the drilling fluid reaches the first pressure, in order to drive the anchoring mechanism 4 to anchor firmly to the inner wall of the wellbore. The sealing mechanism 5 is actuated at the same time to form a seal with the inner wall of the wellbore. Thus the setting procedure is completed.

Specifically, an inner channel of the positioning and orientating apparatus 100 is separated into an upper channel and a lower channel after the ball 9 moves to a position where it is received by the ball seat 73. A pressure is built up in the upper channel, whereby the drilling fluid enters the sealing chamber 65 through the pressure transmitting hole 12 of the orientating coupling shaft 1. As shown in FIG. 8, the pressure of the drilling fluid is exerted on the upper end surface of the piston 63. When the pressure of the drilling fluid reaches the first pressure, the piston 63 pushes the piston sleeve 66 to shear off the first shear pin 67, and at the same time drives the force transmitting cylinder 64 to shear off the second shear pin 68. As the pressure of the drilling fluid increases, the piston 63, the piston sleeve 66 and the force transmitting cylinder 64 are pushed to move downwards along the axial direction. The axial force is transmitted to the motion sleeve 69, which pushes the first cone 42 and the first retaining ring 46 to move downwards along the axial direction, thereby compressing the slips 41 along the axial direction. The first cone 42 and the second cone 43 drive the slips 41 to expand outwards along the radial direction. Thus the slips 41 are anchored securely to the inner wall of the wellbore, so that the anchoring procedure is completed. Meanwhile, the motion sleeve 69 moves axially downwards until the pressure-bearing step 693 thereof comes into contact with the upper end surface of the slip nest 44, which is thus pushed to move downwards along the axial direction, so that the lower end surface of the slip nest 44 engages with the pressure-bearing step at the upper end of the first rubber cylinder gasket 52. Then the first rubber cylinder gasket 52 is pushed along the axial direction, in which case the first rubber cylinder gasket 52 and the second rubber cylinder gasket 53 compress the rubber cylinder 51 together along the axial direction, so that the rubber cylinder 51 expands radially until tightly abutting against the inner wall of the wellbore, thus forming a sealing connection. In this manner, the setting procedure is completed. At this time, the first retaining ring 46 and the second retaining ring 47 can effectively prevent the first cone 42 and the second cone 43 from retreating, thus realizing the permanent anchoring thereof.

Figure 9:
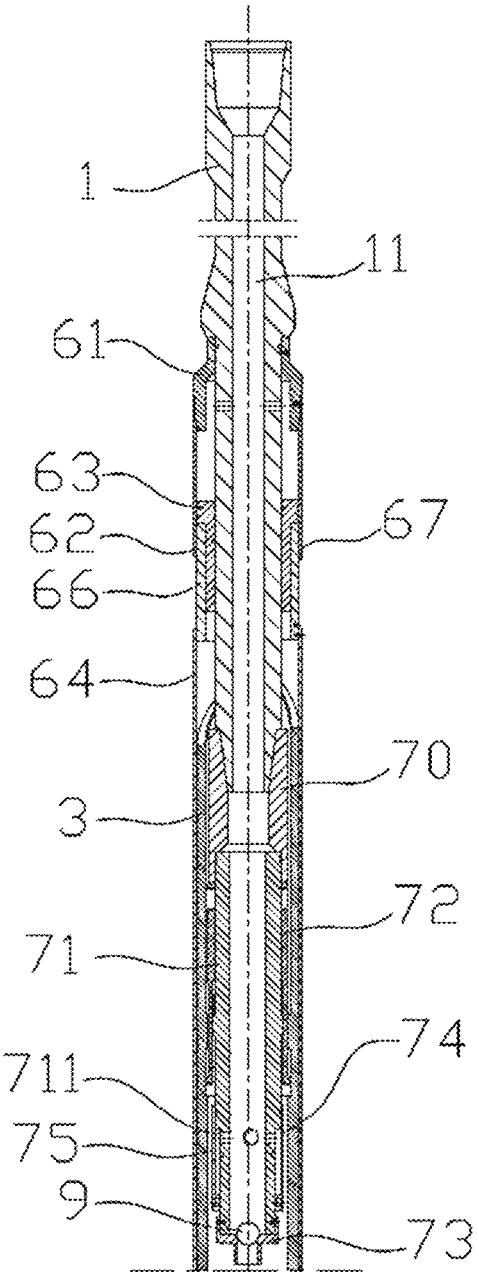
FIG. 9 schematically shows a releasing unit, after being actuated, in the positioning and orientating apparatus for branch well as shown in FIG. 1.
Figure 10:
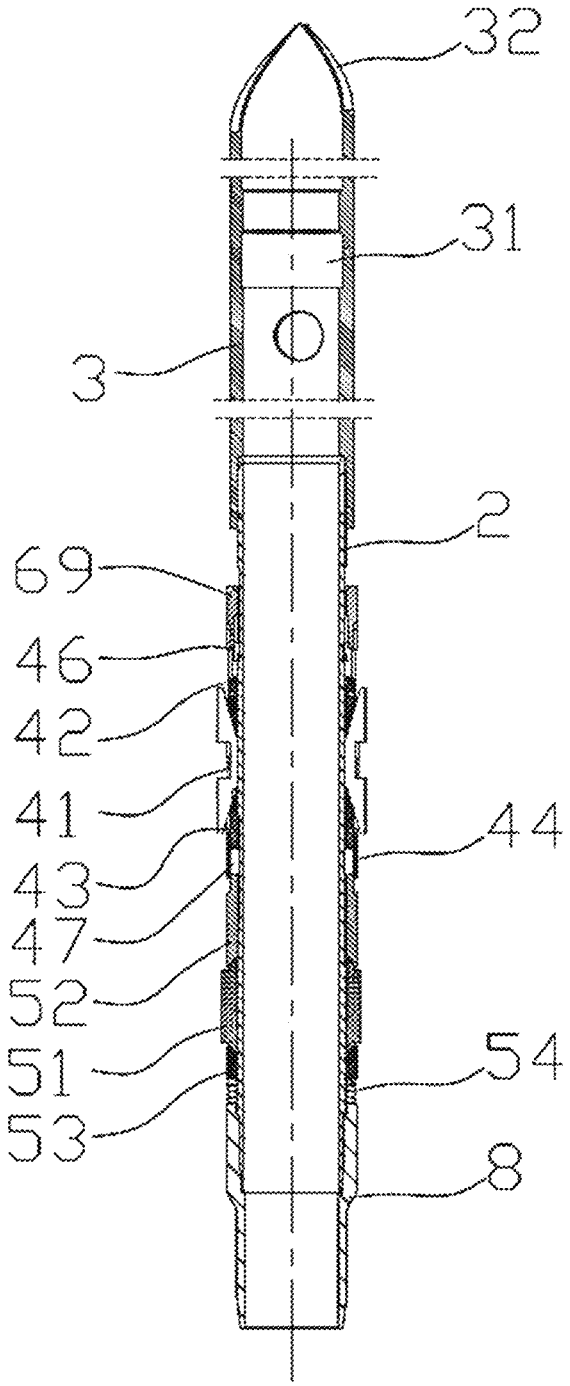
FIG. 10 schematically shows a structure of a downhole portion of the positioning and orientating apparatus for branch well as shown in FIG. 1 after releasing.

In addition, the drilling fluid in the upper channel of the positioning and orientating apparatus 100 also enters the hydraulic chamber 75 through the hydraulic hole 711 of the pressure-bearing cylinder 71. As shown in FIG. 9, when the setting of the positioning and orientating apparatus 100 is completed, it continues to be pressurized. The pressure of the drilling fluid in the hydraulic chamber 75 is exerted on the inner step portion of the shear ferrule 74 until it reaches the second pressure. At this time, the shear ferrule 74 shears off the third shear pin 76 and then moves downwardly, thus removing the radial support for the elastic claw 72. At this time, the releasing unit 7 is lifted up by lifting up the string, so that the elastic claw 72 deforms and the claw portion 721 is disengaged from the slot 31 of the guiding sleeve 3, whereby the releasing unit 7 is separated from the guiding sleeve 3. Thus, it is possible to lift up the releasing unit 7 together with the setting actuation unit 6 out of the wellhead, and leave the hydraulic cylinder 2, the guiding sleeve 3, the setting unit and the downstream portions thereof downhole. In this manner, the releasing procedure can be completed. FIG. 10 schematically shows a structure of a downhole portion of the positioning and orientating apparatus 100 after the releasing procedure.

Then, the subsequent orientating operation can be performed.

According to the present invention, the positioning and orientating apparatus 100 for branch well can be securely anchored to the well wall through the setting unit with a high degree of stability and reliability, which can effectively avoid displacement and realize permanent anchoring at the same time. The guiding sleeve 3 in the positioning and orientating apparatus 100 has a spirally-guiding structure with high positioning and orientating accuracy, which can ensure that the subsequent operations including running a whipstock for windowing can be performed smoothly, and is conducive to the accuracy of positioning and orientating. The positioning and orientating method according to the present invention can realize continuous running, hanging, packing and releasing, which can be operated simply, conveniently and efficiently.

It should be understood that in the present invention, the terms "first" and "second" are used for illustrative purposes only, and are not intended to indicate or imply relative importance or implicitly specify the number of technical features indicated. Thus, the technical features defined with the terms "first" or "second" may explicitly or implicitly include one or more such technical features. In the description of the present invention, "a plurality of" means two or more, unless otherwise specified.

In the present invention, unless otherwise specified or defined, the phrases "mount", "connect", "attach", "fix" and the like, should be understood in a broad sense, and may be understood as, for example, fixed connections, detachable connections, or integral connections; mechanical or electrical connections; direct connections or indirect connections via intermediate structure; or interior communication between two elements. The specific meanings of the above phrases in the present invention can be understood by one skilled in the art in accordance with specific conditions.

The phrases "an embodiment", "some embodiments", "example", "specific example" or "some examples" as mentioned in the description mean that the particular features, structures, materials or characteristics described in conjunction with the embodiment or example are included in at least one embodiment or example of the present invention. Thus, the above illustrative phrases described throughout the description do not necessarily refer to the same embodiment or example. Moreover, the particular features, structures, materials, or characteristics described herein may be combined in any one or more of the embodiments or examples in a suitable manner.

Finally, it should be noted that the foregoing description is merely illustrative of preferred embodiments of the present invention, and is not intended to restrict the present invention. Although the present invention is described in detail with reference to the above embodiments, it is still possible for one skilled in the art to modify the technical solutions defined in the above embodiments or to replace some of the technical features with equivalent ones. Any modifications, equivalent substitutions, improvements, and the like falling within the spirit and principles of the present invention are intended to be included within the scope of protection of the present invention.

The invention claimed is:

1. A positioning and orientating apparatus for branch well, comprising:

an orientating coupling shaft (1), with a central flow channel (11) provided therein for flow of drilling fluid;

a hydraulic cylinder (2), arranged at a downstream end of the orientating coupling shaft (1), with a guiding sleeve (3) fixedly connected to an upper end of the hydraulic cylinder (2);

a setting unit, arranged on the hydraulic cylinder (2), and comprising an anchoring mechanism (4) and a sealing mechanism (5) arranged at a lower end of the anchoring mechanism (4);

a setting actuation unit (6), comprising a sealing cylinder (62) arranged around the orientating coupling shaft (1), a piston (63) arranged inside the sealing cylinder (62), and a force transmitting cylinder (64) arranged around the guiding sleeve (3), wherein an upper end of the force transmitting cylinder extends upwards to be fixedly connected to the piston (63), a sealing chamber (65) in communication with the central flow channel (11) is formed within the sealing cylinder (62), and the piston (63) is configured to drive the force transmitting cylinder (64) to move downwards when a pressure of the drilling fluid reaches a first pressure, in order to drive the anchoring mechanism (4) to be anchored securely to an inner wall of a wellbore, and drive the sealing mechanism (5) to form a seal with the inner wall of the wellbore; and a releasing unit (7), connected to a lower end of the orientating coupling shaft (1), and comprising a pressure-bearing cylinder (71) fixedly connected to the lower end of the orientating coupling shaft (1), an elastic claw (72) arranged around the pressure-bearing cylinder (71), and a ball seat (73) fixedly connected to a lower end of the pressure-bearing cylinder (71), wherein an inner wall of the guiding sleeve (3) is provided with a slot (31) which engages with the elastic claw (72) by snap fitting in an initial state, and the ball seat (73) is configured to receive a ball (9) dropped from a wellhead to build up pressure, so that the elastic claw (72) is separated from the slot (31) by lifting up the releasing unit (7) when the pressure of the drilling fluid reaches a second pressure, thus completing a releasing procedure, wherein the first pressure is less than the second pressure.

2. The positioning and orientating apparatus for branch well according to claim 1, characterized in that the anchoring mechanism (4) comprises:

a slip (41) arranged on an outer surface of the hydraulic cylinder (2); and a first cone (42) and a second cone (43) arranged symmetrically on both axial ends of the slip (41), wherein the slip (41) engages with the first cone (42) and the second cone (43) through tapered surfaces, and is configured to retract in the initial state, and to expand radially outwards when the first cone (42) and the second cone (43) are close to each other in an axial direction due to axial forces, so as to be anchored securely to the inner wall of the wellbore.

3. The positioning and orientating apparatus for branch well according to claim 2, characterized in that the anchoring mechanism (4) further comprises a slip nest (44) provided on an outer side of the first cone (42) and the second cone (43), wherein the slip (41) is connected to the hydraulic cylinder (2) through an elastic member (45), and configured to retract to be located inside the slip nest (44) in the initial state, while extend outwards from the slip nest (44) when the first cone (42) and the second cone (43) are subjected to the axial forces.

4. The positioning and orientating apparatus for branch well according to claim 2, characterized in that an anchor jaw (411) is arranged on a surface of the slip (41) facing away from the hydraulic cylinder (2), and configured as having four-pronged teeth each with an outer edge inclined toward a center of the slip (41).

5. The positioning and orientating apparatus for branch well according to claim 2, characterized in that a first retaining ring (46) is provided at an upper end of the first cone (42), and a second retaining ring (47) is provided at a lower end of the second cone (43), for preventing the first cone (42) and the second cone (43) from retreating, respectively.

6. The positioning and orientating apparatus for branch well according to claim 5, characterized in that the sealing mechanism (5) comprises:

a rubber cylinder (51) arranged on the hydraulic cylinder (2); and a first rubber cylinder gasket (52) and a second rubber cylinder gasket (53) arranged at upper and lower ends of the rubber cylinder (51), respectively, wherein the first rubber cylinder gasket (52) and the second rubber cylinder gasket (53) are configured to, when axially close to each other due to axial forces, press the rubber cylinder (51) to expand outwardly along a radial direction until tightly abutting against the inner wall of the wellbore, thereby forming a seal.

7. The positioning and orientating apparatus for branch well according to claim 6, characterized in that a force-bearing step is formed at an upper end of the first rubber cylinder gasket (52), for engagement with a lower end of the slip nest (44) to transmit axial force.

8. The positioning and orientating apparatus for branch well according to claim 6, characterized in that a lower joint (8) is fixedly connected to a lower end of the hydraulic cylinder (2), and a cushioning member (54) is provided between the second rubber cylinder gasket (53) and the lower joint (8) along the axial direction, for cushioning compression on the rubber cylinder (51).

9. The positioning and orientating apparatus for branch well according to claim 6, characterized in that an upper end of the sealing cylinder (62) is fixedly connected to the orientating coupling shaft (1) through a sealing joint (61), and the sealing chamber (65) is formed between the sealing joint (61) and the orientating coupling shaft (1), wherein a pressure transmitting hole (12) for communicating with the sealing chamber (65) is formed on a wall of the orientating coupling shaft (1).

10. The positioning and orientating apparatus for branch well according to claim 9, characterized in that an annular projection (631) extending outwards in the radial direction is arranged on an upper outer wall of the piston (63), and a piston sleeve (66) is arranged around the piston (63), a lower end of the piston sleeve (66) extending downwardly to be fixedly connected to the force transmitting cylinder (64), and an upper end thereof abutting against a lower end surface of the annular projection (631), wherein in the initial state, the piston sleeve (66) is fixedly connected to the sealing cylinder (62) through a first shear pin (67), and the force transmitting cylinder (64) is fixedly connected to the guiding sleeve (3) through a second shear pin (68), and when the pressure of the drilling fluid in the sealing chamber (65) reaches the first pressure, the first shear pin (67) and the second shear pin (68) are simultaneously sheared off, so that the piston (63) drives the force transmitting cylinder (64) to move downwards.

11. The positioning and orientating apparatus for branch well according to claim 10, characterized in that the setting actuation unit (6) further comprises a motion sleeve (69) arranged on the hydraulic cylinder (2) and between the force transmitting cylinder (64) and the first cone (42), for transmitting the axial force from the force transmitting cylinder (64) to the first cone (42).

12. The positioning and orientating apparatus for branch well according to claim 11, characterized in that a shoulder (691) with an end surface facing downwards is provided on an inner wall of the motion sleeve (69), so that an annular space (692) with an opening facing downwards is formed between the shoulder (691) and the hydraulic cylinder (2), wherein the first retaining ring (46) is arranged in the annular space (692).

13. The positioning and orientating apparatus for branch well according to claim 1, characterized in that the releasing unit (7) further comprises a shear ferrule (74) arranged on the pressure-bearing cylinder (71), and a hydraulic chamber (75), which is formed between the shear ferrule (74) and the pressure-bearing cylinder (71), is in communication with a hydraulic hole (711) on a wall of the pressure-bearing cylinder (71), wherein in the initial state, the shear ferrule (74) is fixedly connected to the pressure-bearing cylinder (71) through a third shear pin (76), an upper end of the shear ferrule (74) extends to a radially inner side of the elastic claw (72) to radially support the elastic claw (72), and the shear ferrule (74) is configured to shear off, when the pressure of the drilling fluid in the hydraulic chamber (75) reaches the second pressure, the third shear pin (76) and then move downwards to remove radial support for the elastic claw (72).

14. The positioning and orientating apparatus for branch well according to claim 1, characterized in that an upper portion of the guiding sleeve (3) is provided with a spirally-shaped guiding track (32) and a positioning slot (33), and the guiding sleeve (3) is configured to, when being tied back with an upper string, guide a positioning key of the upper string to slide into the positioning slot (33) via the guiding track (32), thus achieving orientation of the upper string.

15. A positioning and orientating method for branch well, comprising steps of:

providing the positioning and orientating apparatus for branch well according to claim 1;

lowering the positioning and orientating apparatus to a predetermined position in the wellbore;

dropping the ball (9) from the wellhead to be received by the ball seat in the releasing unit (7) to build up pressure, and when the pressure of the drilling fluid reaches the first pressure, driving, by the setting actuation unit (6), the anchoring mechanism (4) to anchor securely to the inner wall of the wellbore, and at the same time, driving the sealing mechanism (5) to form a seal with the inner wall of the wellbore, thus completing the setting procedure; and building up the pressure continuously until the pressure of the drilling fluid reaches the second pressure, and lifting up the releasing unit (7) to separate it from the guiding sleeve (3), so that the releasing unit (7) and the setting actuation unit (6) are lifted out of the wellhead together, thereby completing the releasing procedure.

* * * * *